United States Patent [19]

Schwerdtel et al.

[11] Patent Number: 4,874,022

[45] Date of Patent: Oct. 17, 1989

[54] FILLING STATION FOR A CARTRIDGE FILLING AND SEALING MACHINE

[75] Inventors: Ernst Schwerdtel, Munich; Hans-Jörg Lang, Eisenhofen, both of Fed. Rep. of Germany

[73] Assignee: Ludwig Schwerdtel GmbH, Karlsfeld, Fed. Rep. of Germany

[21] Appl. No.: 195,781

[22] Filed: May 5, 1988

[30] Foreign Application Priority Data

May 14, 1987 [DE] Fed. Rep. of Germany ..... 3716119

[51] Int. Cl.[4] ..... B65B 43/58

[52] U.S. Cl. ..... 141/165; 141/172; 141/170

[58] Field of Search ..... 141/165, 164, 172, 187, 141/137, 103, 113, 163, 101, 263, 368, 369, 370, 371, 373, 378; 294/64.1, 64.3, 65; 414/627; 207/905; 53/367, 567, 505

[56] References Cited

U.S. PATENT DOCUMENTS

| | | | |
|---|---|---|---|
| 2,839,094 | 6/1958 | Reno | 141/263 |
| 3,227,481 | 1/1966 | Creskoff | 294/64.1 |
| 3,237,662 | 3/1966 | Hawley | 141/263 |
| 3,578,372 | 5/1971 | Schuler | 294/64.1 |
| 3,837,378 | 9/1974 | Kanki et al. | 141/165 |
| 4,712,665 | 12/1987 | McDonald et al. | 141/172 |

FOREIGN PATENT DOCUMENTS

| | | | |
|---|---|---|---|
| 271320 | 4/1964 | Australia | 414/627 |
| 113172 | 2/1969 | Denmark | 294/64.1 |
| 3116458 | 11/1982 | Fed. Rep. of Germany | 141/65 |

*Primary Examiner*—Henry J. Recla
*Assistant Examiner*—Edward C. Donovan
*Attorney, Agent, or Firm*—Browdy & Neimark

[57] ABSTRACT

A filling station for a cartridge filling and sealing machine for filling viscous or pasty materials into cylindrical cartridges having a filler valve, a positioning and centering device for positioning and centering the cartridges in a position in alignment with the filler valve, and a displacement drive for adjusting the positioning of the positioning and centering device the filler valve in relation to each other. In order to assure an exactly centered position of the cartridge prior to inserting the filler valve into the cartridge as well as dependable support of the cartridge in a non-deforming way prior to and during filling, the positioning and centering device has a unit and at least one vacuum suction holder disposed in the unit. The unit has a contact surface adapted to the outer shape of the cartridge. The vacuum suction holder is formed by a suction hose the open end of which is disposed in the unit.

21 Claims, 5 Drawing Sheets

FILLING STATION FOR A CARTRIDGE FILLING AND SEALING MACHINE

BACKGROUND OF THE INVENTION

1. Field of the Invention

The invention relates to a filling station for a cartridge filling and sealing machine for filling viscous or pasty materials into cylindrical cartridges, having a filler valve, a positioning and centering device for positioning and centering the cartridges in a position in alignment with the filler valve, and with a displacement drive for adjusting the positioning and centering device and the filler valve in relation to each other.

2. The Prior Art

For the purpose of filling, the normally circular cylindrical and thin-walled cartridge is supported in such filling stations from below by support fingers of a positioning and centering device, into which it is pushed from above by means of a spring lever or a pneumatic cylinder. When a spring lever is used, the support of the cartridge is not secure enough so that when the cartridge is moved under the filler valve it may slip. If the thin-walled cartridge is pushed by means of a pneumatic cylinder it is deformed, so that satisfactory filling is not possible.

SUMMARY OF THE INVENTION

It is therefore an object of the invention to improve a filling station according to the species such that an exactly centered position of the cartridge prior to the insertion of the filler valve into the cartridge and a reliable support prior to and during filling, which does not deform the cartridge, is achieved.

This object is attained by the invention in that the positioning and centering device comprises a unit and at least one vacuum suction holder disposed in the unit. According to the invention the cartridge is pulled into the positioning and centering device by means of the at least one vacuum suction holder. Thus the cartridge is only stressed from one side by holding forces and therefore is not crushed and thus deformed. Furthermore, absolutely sure centering is assured because the cartridge cannot change its position relative to the unit. Thus, the unit has a contact surface adapted to the outer shape of the cartridges and the cartridge is cylindrical. The vacuum suction holder is formed by a suction hose in the shape of a bellows and having an open end which is disposed in the unit and extends beyond the contact surface. Thus, the cartridge is grasped by means of the suction hose or suction hoses already during transport in the direction of the unit, the hoses then shortening as they pull the cartridge against the contact surface, i.e., to center the cartridge.

The positioning and centering device disposed on a cartridge which is movable parallel to the central longitudinal axis of the filler valve and to another cartridge makes possible a particularly simple movement of filler valve and centered cartridge in relation to each other.

If pasty, i.e., no longer flowable material, is to be filled into the cartridges, the cartridges are normally transported and filled in a horizontal position, i.e., the filler valve also is in a horizontal position. If, however, viscous but still flowable materials are to be injected, the cartridges must be transported and filled in a vertical position or at least in a position clearly inclined from the horizontal towards the vertical. The filling station according to the invention is usable in any of the cases.

In cases where the cartridges are transported with their center longitudinal axes in a horizontal position, a simple method of lifting the cartridge from its lower position of rest up to the positioning and centering device can be used. According to this, the cartridges can be transported through the filling station in a generally horizontal orientation. Guides are provided for receiving the cartridges in a position of rest. The positioning and centering device is disposed above the guides for the cartridges. The contact surface is open in the direction towards the guide and a lifting device is provided for lifting the cartridges off the guides towards the positioning and centering device. The lifting device has at least one drive with a receiver for the cartridge.

BRIEF DESCRIPTION OF THE DRAWINGS

Further details of the invention are disclosed in the following description of an exemplary embodiment by means of the drawings in which.

DETAILED DESCRIPTION OF THE PREFERRED EMBODIMENT

Figure 2:
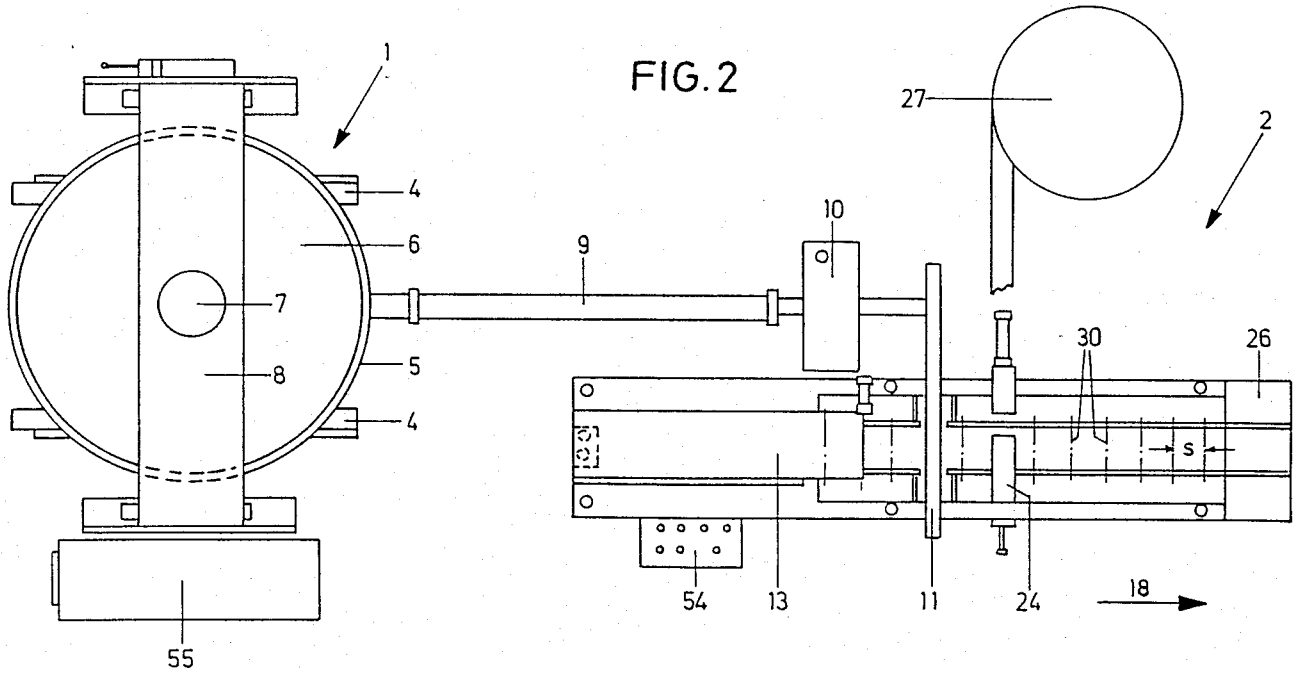
FIG. 2 is a top view of the installation according to FIG. 1.
Figure 3:
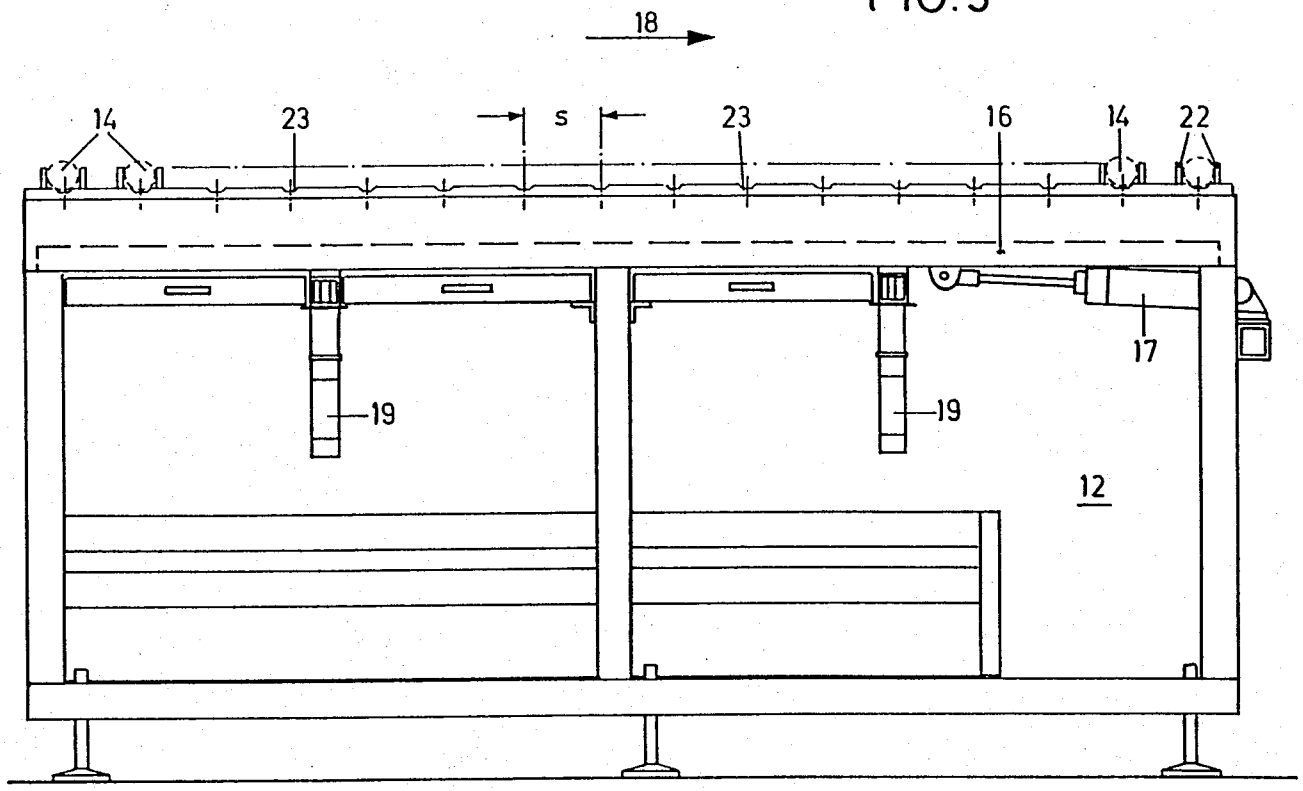
FIG. 3 is a vertical side view of a frame of a cartridge filling and sealing machine of the installation in accordance with FIGS. 1 and 2.

An installation for filling and sealing of cartridges with non-flowable pasty materials consists in general of a press 1 and a cartridge filling and sealing machine 2. The press 1 has a vertically extending frame-like mount 3 with lower support bars 4 for a reservoir 5 containing pasty material. A pressure plate 6 is disposed above the cylindrical reservoir 5 which can be pushed into the reservoir 5 by means of a hydraulically actuable working piston 7. The working piston 7 is braced against an upper transverse cross-head 8 of the frame 3 as shown in FIG. 2. By correspondingly pushing down the pressure plate 6 into the reservoir 5, the pasty material is pushed out of it into a transport conduit 9 through which it is supplied to a metering device 10 associated with the machine 2.

From the metering device 10 the pasty material is supplied in exactly measured amounts to a filling station 11 to be described in detail further below.

Figure 1:
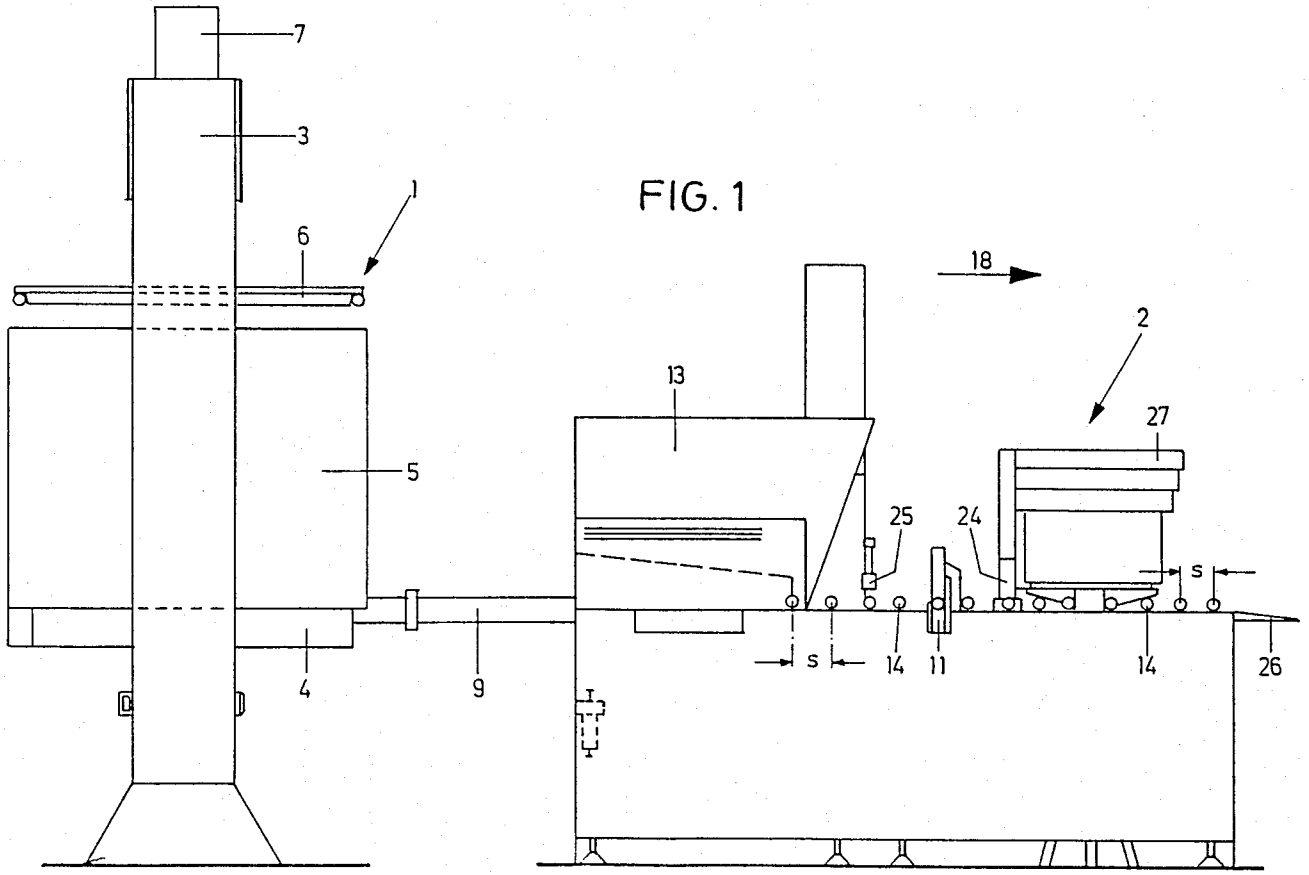
FIG. 1 is a vertical longitudinal view of an installation for filling and sealing cartridges with pasty material.

The cartridge filling and sealing machine 2 in general has a horizontally extending machine frame 12 on one side of which the left side in FIGS. 1 and 2, respectively, a cartridge magazine 13 is disposed.

The stepwise transport of cartridges 14 from the magazine 13 along different work stations is accomplished by means of a so-called rack 15. This rack 15 comprises a carriage 16 fixed in the machine frame 12, which can be moved by means of a pneumatically activated piston-cylinder drive 17 in the working direction 18 and counter to this working direction by an amount s of a process step. Pneumatically activated piston-cylinder drives 19 are fixed on carriage 16 which can be moved in a vertical direction, i.e., vertically to the working direction 18. The piston rods 20 of drive 19 each have a transport platform 21 with four each engaging means 22 arranged in pairs, the distance of each pair of engaging means 22 from the adjacent pair being equal to the amount s of a process step. On the machine frame 12 itself are disposed V-guides 23 for the cartridges 14, between which the transport plate 21 with the engaging means 22 of the rack 15 is disposed. During operation one cartridge 14 lies between each pair of guides 23. In this position the transport plate 21 is located a little below the guides 23. To continue the movement in the working direction 18 by the amounts of a process step, first the drives 19 are activated in a vertical direction so that the cartridges 14 are raised upwardly from the guides 23. Then the drive 17 is activated in such a way that it displaces the entire carriage 16 with the rack 15 in the working direction 18 by the amount s. Then the drives 19 are activated in such a way that the transport plate 21 with the engaging means 22, i.e. the rack 15, is lowered so that all cartrigdes 14 are again deposited on the guides 23. The rack 15 is lowered far enough that the engaging means 22 are free of the underside of the cartridges 14 lying on the guides 23. By reverse activation of the drive 17 the rack is then returned to its initial position. By this movement of the rack 15 on an approximately rectangular track—seen from the side—the cartridges can always be moved by one process step in the working direction 18. The work stations mentioned are, besides the already mentioned filling station 11, a sealing station 24 and, if desired, a stamping station 25 where a stamp is applied to the cartridges 14. The sealed cartridges 14 leave the machine 2 at the end opposite the magazine 13 via an exit ramp 26. A sorting device 27 for pistons for sealing the cartridges 14 is placed ahead of the sealing station 24.

The filling station 11 has a filler valve 28 with a pipe-like outer shape, the central longitudinal axis 29 of which extends parallel to the central longitudinal axes 30 of the cartridges 14 resting on the guides 23. The outer diameter D of the filler valve 28 is somewhat smaller than the inner diameter d of the cartridges 14, so that these can be pushed completely over the filler valve 28 for filling with the pasty material. To the extent that the installation has been described so far, it is known and common.

Figure 5:
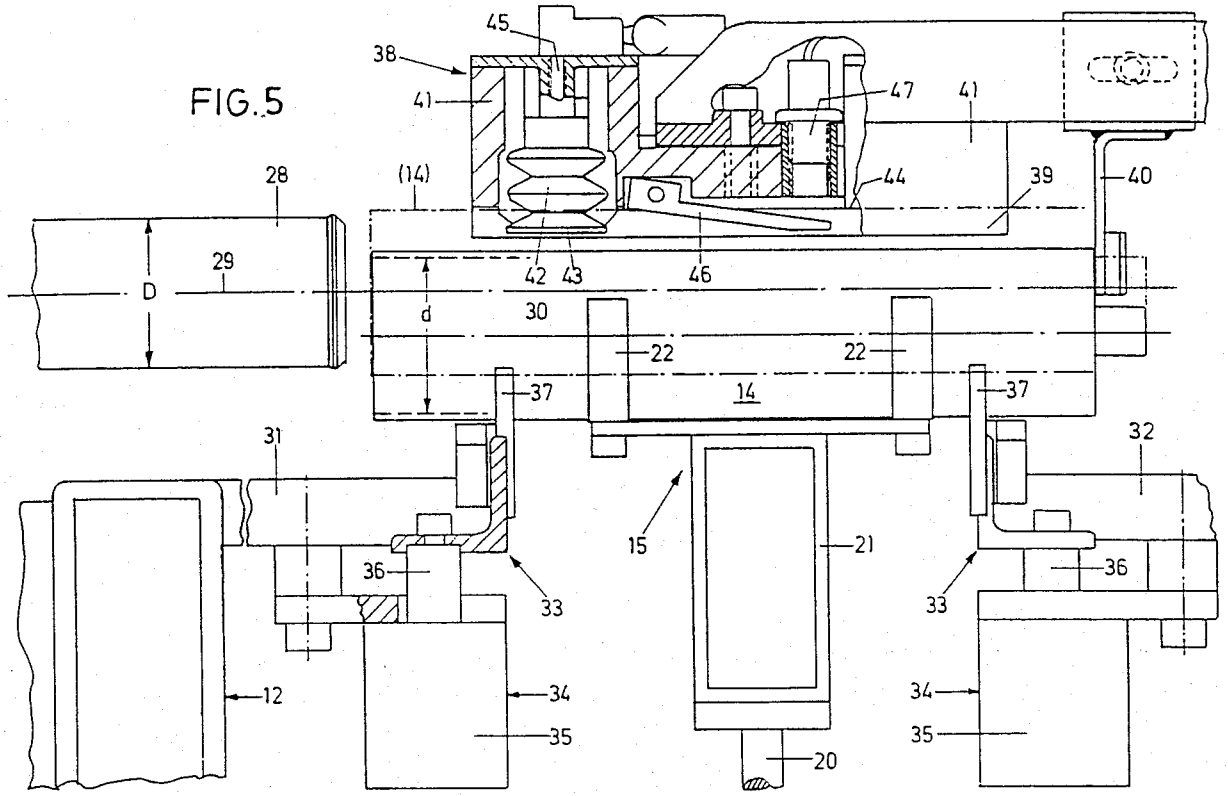
FIG. 5 is a partial section from FIG. 4 in a scale enlarged in comparison with FIG. 4.

As can be seen in particular from FIG. 5, the machine frame 12 is covered on top by means of two cover plates 31, 32 which support on their edges oriented towards each other the guides 23 and between which is disposed the rack 15. One lifting device 33 each is assigned to both guides 23 associated with the filling station 11 and has a lifting drive 34 in the form of a piston-cylinder drive, the cylinders 35 of which are respectively disposed on the underside of the cover plate 31 or 32. On the respective piston rod 36 is provided a respective receiver 37, by means of which the corresponding cartridge 14 can be grasped from below. By a corresponding pneumatic activation of the lifting drives 34 it is thus possible to lift the cartridge 14 present in the associated guides 23 out of these guides 23 and transport it upward to a positioning and centering device 38 for a cartridge, located above it. In FIG. 5 the cartridge 14 is shown by dashdotted lines in this position.

The positioning and centering device 38 has an abutting part or unit 39 having a contact surface for the cartridges in the shape of a section of a cylinder adapted to the shape of the cartridge inside which the cylindrical, thin-walled and easily deformable cartridge 14 is centered such that its axis 30 is in alignment with the axis 29 of the filler valve 28. The already sealed end of the cartridge 14 opposite the filler valve 28 abuts on a stop which serves as a safeguard 40 against movement. The cartridge 14 is maintained in the unit 39 by means of two vacuum suction holders 41, only one of which—left in FIG. 5—is illustrated. These vacuum suction holders 41 each have a bellows-like suction hose 42, the lower open end 43 extends beyond cylinder-section-like contact surfaces 44 of the part or unit 39. Air is aspirated through these open ends 43 via a vacuum line 45, only suggested. When in the course of the already described lifting of the cartridge 14 by means of the lifting device 33, the top of the cartridge contacts the two open ends 43 of the bellows-like suction hoses 42, the two open ends 43 are closed by the cartridge 14. Based on this, the two suction hoses 42 contract because of the lower pressure in their interior, for which reason the cartridge is pulled into the unit 39 and is centered there on and held against the contact surface 44. These elastic bellows-like suction hoses 42 can also move cross-wise to their longitudinal direction so that a perfect centering of the cartridge in the unit 39 is assured. A pivot lever 46 is disposed in the unit 39 which is lifted by the cartridge 14 as it is pulled into the unit 39. In the centered position of the cartridge 14 in the unit 39, the pivot lever is completely pivoted upwards and thereby activates a signal transmitter 47 which triggers an automatic sequence control.

Figure 4:
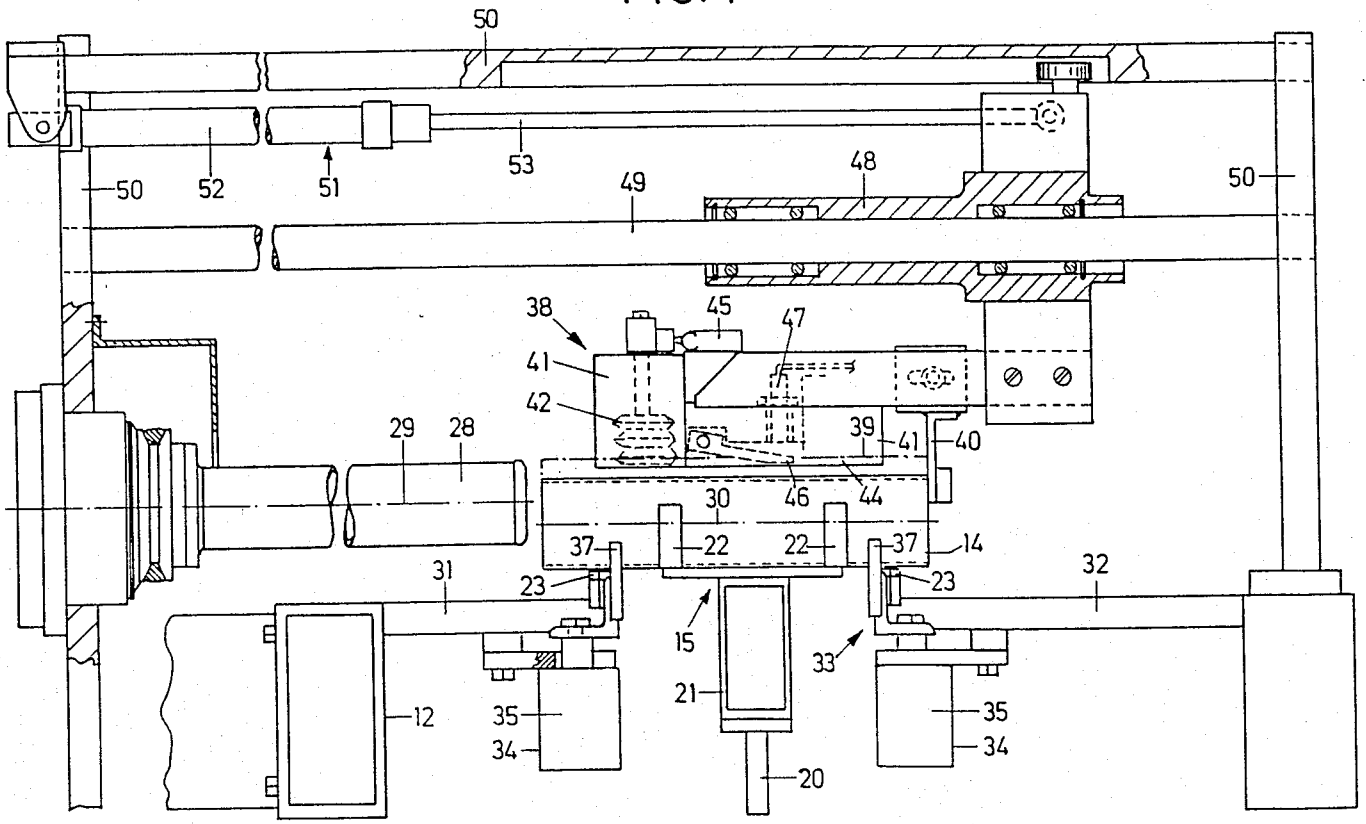
FIG. 4 is a side view of a filling station of the cartridge filling and sealing machine.

The positioning and centering device 38 is disposed on a pipe-like carriage 48 which is moveably disposed parallel to the central longitudinal axes 29, 30 on a guide bar 49. The guide bar 49 is fixedly attached to the frame 50 of the filling station 11 which, in turn, is disposed on the machine frame 12. A displacement drive 51 in the form of a pneumatically actuable piston-cylinder drive is provided for driving the carriage 48 and thus the positioning and centering device 38, the cylinder 52 of which is fixed on the frame 50, while its piston rod 53 is connected with the carriage 48. If, as mentioned, the signal transmitter 47 emits a signal because of the upward pivoting of the pivot lever 46, the cylinder 52 of the displacement drive 51 is charged with compressed air such that the piston rod 53 is pulled inside it. The carriage 48 with the positioning and centering device 38 is thus displaced in such a way—to the left in FIGS. 4 and 5—that the cartridge 14 present in the device 38 is pushed over the filler valve 28. Then pressure is released from the cylinder 52. At the same time, filling of the cartridge 14 is begun by the metering device 10 pushing a corresponding amount of pasty material through the filler valve 28 into the cartridge. Because of the pressure during filling, the cartridge 14 is pushed off the filler valve 28 in relation to the degree of filling, i.e., the positioning and centering device 38, together with the carriage 48 is pushed in the opposite direction, because of which is piston rod 53 is pulled out of the cylinder 52 of the displacement drive 51. At the end of the filling process, the cylinder 52 is charged with compressed air in the exhaust direction of the piston rod 53, so that the carriage 48 with the device 38 and the filled cartridge 14 is returned into the starting position again, in which the cartridge 14 is clear of the filler valve 28. Following this, the cartridge is lowered onto the guides 23 by charging the suction hoses 42 of the vacuum suction holders 41. The lifting drives 34 are charged in such a way that the cartridge 14 is lowered and again deposited on the guides 23. Then the cartridge is moved on by means of the rack 15 by one process step in a manner already described so that it arrives at the sealing station 24.

The control processes described are controlled on the one hand from a control panel 54 disposed on the machine frame 12 and, on the other hand, from a central control unit 55.

It should be understood that exemplary embodiment described above has been given by way of example only and that further improvements and variants are possible within the scope of the invention.

What is claimed is:

1. A filling station for a cartridge filling and sealing machine for filling viscous or pasty materials into cylindrical cartridges, comprising:

a filler valve;

a positioning and centering device for positioning and centering the cartridges in a position in alignment with said filler valve, a displacement drive for adjusting the position of said positioning and centering device and the filler valve in relation to each other; and said positioning and centering device comprising a unit having a contact surface for the cartridges and at least one vacuum suction holder disposed in said unit, said at least one vacuum suction holder comprising a suction hose having an open end disposed in said unit, the open end of said suction hose extending beyond said contact surface and being in the shape of a bellows.

2. A filling station in accordance with claim 1, wherein said contact surface is adapted to the outer shape of the cartridges.

3. A filling station in accordance with claim 2, wherein each of the cartridges is cylindrical and said contact surface is in the shape of a section of a cylinder.

4. A filling station in accordance with claim 3, wherein said positioning and centering device is disposed on a carriage which is movable parallel to the central longitudinal axis of said filler valve and the cartridges, as they are positioned in said positioning and centering device.

5. A filling station in accordance with claim 2, wherein the cartridges can be transported through the filling station such that their central longitudinal axes are in a generally horizontal position and said station further comprises guides provided for receiving the cartridges in a position of rest, said positioning and centering device being disposed above said guides for the cartridges, said contact surface being open in the direction towards said guides and a lifting device provided for lifting the cartridges off said guides towards said positioning and centering device.

6. A filling station in accordance with claim 5, wherein said lifting device comprises at least one lifting drive with a receiver for the cartridge.

7. A filling station in accordance with claim 1, further comprising activating means for activating a signal transmitter which triggers an automatic sequence control, said activating means comprising a pivot lever disposed in said unit.

8. A filling station for a cartridge filling and sealing machine for filling viscous or pasty materials into cylindrical cartridges, comprising:

a filler valve;

a positioning and centering device for positioning and centering the cylindrical cartridges in a position in alignment with said filler valve, said positioning and centering device being disposed on a carriage which is movable parallel to the central longitudinal axis of said filler valve and the cartridges as they are positioned in said positioning and centering device;

a displacement drive for adjusting the position of said positioning and centering device and the filler valve in relation to each other; and said positioning and centering device comprising a unit having a contact surface in the shape of a section of a cylinder adapted to the outer shape of the cartridges, and at least one vacuum suction holder disposed in said unit.

9. A filling station in accordance with claim 8, wherein said at least one vacuum suction holder comprises a suction hose having an open end disposed in the unit.

10. A filling station in accordance with claim 9, wherein said suction hose is in the shape of a bellows.

11. A filling station in accordance with claim 9, wherein the open end of said suction hose extends beyond said contact surface.

12. A filling station in accordance with claim 8, wherein the cartridges can be transported through the filling station such that their central longitudinal axes are in a generally horizontal position and said station further comprises guides provided for receiving the cartridges in a position of rest, said positioning and centering device being disposed above said guides for the cartridges, said contact surface being open in the direction towards said guides and a lifting device provided for lifting the cartridges off said guides towards said positioning and centering device.

13. A filling station in accordance with claim 12, wherein said lifting device comprises at least one lifting drive with a receiver for the cartridge.

14. A filling station in accordance with claim 8, further comprising activating means for activating a signal transmitter which triggers an automatic sequence control, said activating means comprising a pivot lever disposed in said unit.

15. A filling station for a cartridge filling and sealing machine for filling viscous or pasty materials into cylindrical cartridges, comprising:

a filler valve;

a positioning and centering device for positioning and centering the cartridges in a position in alignment with said filler valve;

a displacement drive for adjusting the position of said positioning and centering device and the filler valve in relation to each other; and said positioning and centering device comprising a unit having a contact surface for the cartridges adapted to the outer shape of the cartridges, and at least one vacuum suction holder disposed in said unit;

wherein the cartridges can be transported through the filling station such that their central longitudinal axes are in a generally horizontal position and said station further comprises guides provided for receiving the cartridges in a position of rest, said positioning and centering device being disposed above said guides for the cartridges, said contact surface being open in the direction towards said guides and a lifting device provided for lifting the cartridges off said guides towards said positioning and centering device.

16. A filling station in accordance with claim 15, wherein said at least one vacuum suction holder comprises a suction hose having an open end disposed in the unit.

17. A filling station in accordance with claim 16, wherein said suction hose is in the shape of a bellows.

18. A filling station in accordance with claim 16, wherein the open end of said suction hose extends beyond said contact surface.

19. A filling station in accordance with claim 15, wherein each of the cartridges is cylindrical and said contact surface is in shape of a section of a cylinder.

20. A filling station in accordance with claim 15, wherein said lifting device comprises at least one lifting drive with a receiver for the cartridge.

21. A filling station in accordance with claim 15, further comprising activating means for activating a signal transmitter which triggers an automatic sequence control, said activating means comprising a pivot lever disposed in said unit.

* * * * *